US005582783A

United States Patent [19]

Zikeli et al.

[11] Patent Number: 5,582,783

[45] Date of Patent: Dec. 10, 1996

[54] PROCESS FOR CONTROLLING A FLOWING CELLULOSE SUSPENSION

[75] Inventors: Stefan Zikeli, Regau; Ulrich Möderl, Lenzing; Friedrich Ecker, Timelkam; Franz Schwenninger, Lenzing, all of Austria

[73] Assignee: Lenzing Aktiengesellschaft, Lenzing, Austria

[21] Appl. No.: 459,130

[22] Filed: Jun. 2, 1995

[30] Foreign Application Priority Data

May 4, 1995 [AT] Austria ..... 763/95

[51] Int. Cl.[6] ..... B29C 47/36; D01D 1/02

[52] U.S. Cl. ..... 264/40.4; 264/187

[58] Field of Search ..... 264/40.4, 187; 162/198

[56] References Cited

U.S. PATENT DOCUMENTS

| | | |
|---|---|---|
| Re. 32,101 | 4/1986 | Ricciardi et al. . |
| Re. 32,102 | 4/1986 | Ricciardi et al. . |
| 4,054,784 | 10/1977 | Ricciardi et al. . |
| 4,111,272 | 9/1978 | Ricciardi et al. . |
| 4,210,963 | 7/1980 | Ricciardi et al. . |

FOREIGN PATENT DOCUMENTS

| | | |
|---|---|---|
| 356419 | 2/1990 | European Pat. Off. . |
| 553070 | 7/1993 | European Pat. Off. . |
| 94-28212 | 12/1994 | WIPO . |

OTHER PUBLICATIONS

English language abstract of EP 356,419 (Published Feb. 28, 1990).

English language abstract of EP 553,070 (Published Jul. 28, 1993).

*Primary Examiner*—Leo B. Tentoni

*Attorney, Agent, or Firm*—Brumbaugh, Graves, Donohue & Raymond

[57] ABSTRACT

The invention is concerned with a process for controlling a flowing suspension of shredded cellulose in a liquid, aqueous tertiary amine-oxide and is characterized by the combination of measures that (A) the suspension is introduced into a vessel having an inlet for the suspension, (B) the suspension introduced into the vessel is transported through the vessel and (C) the suspension transported throught the vessel is discharged from the vessel by means of an outlet, (D) the weight of the vessel being measured and the introduction and discharging of the suspension being controlled by means of deviations from a predetermined set value.

5 Claims, No Drawings

PROCESS FOR CONTROLLING A FLOWING CELLULOSE SUSPENSION

FIELD OF THE INVENTION

The invention is concerned with a process for controlling a flowing suspension of celluose in an aqueous tertiary amine-oxide. For the purposes of this application, the term "controlling" is to be understood also as measuring and regulating.

BACKGROUND OF THE INVENTION

For some decades there has been a search for processes for the production of cellulose moulded bodies able to substitute the viscose process, today widely employed. As an alternative which is interesting among other reasons for its reduced environmental impact, it has been found to dissolve cellulose without derivatisation in an organic solvent and extrude from this solution moulded bodies, e.g. fibres, films and other moulded bodies. Fibres thus extruded have received by BISFA (The International Bureau for the Standardization of man made fibers) the generic name Lyocell. By an organic solvent, BISFA understands a mixture of an organic chemical and water.

It has turned out that as an organic solvent, a mixture of a tertiary amine-oxide and water is particularly appropiate for the production of cellulose moulded bodies. N-Methylmorpholine-N-oxide is primarily used as the amine-oxide. Other amine-oxides are described e.g. in EP-A-0 553 070. A process for the production of mouldable cellulose solutions is known e.g. from EP-A-0 356 419. The production of cellulose moulded bodies using tertiary amine-oxides is generally referred to as an amine-oxide process.

In EP-A-0 356 419, an amine-oxide process for the production of spinnable cellulose solutions using as starting material, among other substances, a suspension of cellulose in liquid, aqueous N-methylmorpholine-N-oxide (NMMO) is described. This process consists in transforming the suspension in a thin-film treatment apparatus in a single step and continuously into a mouldable solution. Finally, the mouldable solution is spun into filaments in a forming tool such as a spinneret, the filaments being conducted through a precipitation bath.

As mentioned above, as a starting material for the production of the mouldable cellulose solution, a suspension of cellulose in aqueous tertiary amine-oxide is used. This suspension is produced by introducing shredded cellulose into the aqueous amine-oxide solution. Subsequently, this suspension, optionally after being homogenized once more, is transformed into the cellulose solution. For this step, conveniently a thin-film treatment apparatus such as a FILMTRURER® manufactured by Buss AG, Switzerland, is used. In the thin-film treatment apparatus, those concentration ratios are adjusted which according to the phase diagramm for the ternary substance mixture cellulose/amine-oxide/water (see e.g. WO 94/28212) allow for the cellulose to dissolve.

The more precise the dosage of the cellulose suspension, the better the results of the amine-oxide process. Due to the consistency of the suspension however, controlling the flow of such a suspension is inaccurate for the purposes of the amine-oxide process. By means of conventional mass flowmeters such as inductive flowmeters or measuring instruments using the Coriolis measuring principle, a precise control of the flowing suspension or a precise dosage is not possible, due to the inhomogenities, air bubbles etc. of the cellulose suspension.

SUMMARY OF THE INVENTION

Thus it is the object of the present invention to provide a process whereby a flow of a suspension of shredded cellulose can be controlled in a better way than known in the art.

The process according to the invention for controlling a flow of a suspension of shredded cellulose in a liquid, aqueous tertiary amine-oxide is characterized by the combination of the following measures:

(A) the suspension is introduced into a vessel having an inlet for the suspension, (B) the suspension introduced into the vessel is transported through the vessel and (c) the suspension transported through the vessel is discharged through an outlet, (D) the weight of the vessel being measured and the introduction and discharge of the suspension being controlled by means of deviations from a predetermined set value.

It has been shown that by means of the process according to the invention, a more precise control of the suspension flow than by means of conventional flowmeters is possible.

The process according to the invention is particularly appropiate for controlling the flow of a cellulose suspension exhibiting the following composition:

Cellulose: 12 to 15% by mass;

Water: 18 to 25% by mass;

Tertiary amine-oxide: 60 to 65% by mass, wherein % by mass is based on the total mass of the suspension.

A preferred embodiment of the process according to the invention consists in that as the vessel a pump or another transport device is employed.

Another preferred embodiment of the process according to the invention consists in that as the vessel a buffer vessel is employed. It also has proven convenient to use combinations of a buffer vessel and a pump or a transport device.

DETAILED DESCRIPTION OF THE PREFERRED EMBODIMENTS

By means of the following Example, the invention will be explained in more detail.

EXAMPLE

The test equipment consisted substantially in a storage tank, an eccentric screw pump of the Netzsch Mohno 2NSP30 type, whereby a cellulose suspension was delivered from the storage tank into a thin-film treatment apparatus, a weighing device (pressure-load weighing cell manufactured by Phillips Wägetechnik GmbH, Hamburg, Germany) and an electronic control device, whereby the pumping capacity was controlled according to the weighing data. The storage tank and the eccentric screw pump were located on the weighing device whereby the total weight of the storage tank having the eccentric screw pump attached thereto including the cellulose suspension contained therein was measured.

The conduit through which the cellulose suspension was delivered from the storage tank into the thin-film treatment apparatus consisted of a flexible material and thus did not interfere with the weighing data.

The cellulose suspension had the following composition: Cellulose: 12.5% by mass; N-methylmorpholine-N-oxide: 63.5% by mass; water: 24.0% by mass, based on the total mass.

The electronic control device was programmed so as to control the pumping capacity in such a way that the weighing device was to register a weight decrease of as precisely as possible to 300 kg/h attributable to the delivered cellulose suspension.

To carry out the test, the suspension delivered by the pump during periods of 15 seconds was weighed 18 times respectively and extrapolated to a suspension flow of the dimension kg/h. The results are indicated in the following Table in the column "Suspension flow according to invention".

For comparison, the cellulose suspension was delivered from the same storage tank by the same pump, the pumping capacity however not being controlled according to the invention, but by means of a conventional inductive flowmeter (PROMAG type, made by Endress und Hauser) provided downstream to the pump, which should control the pumping capacity also as precisely as possible to 300 kg/h. In time intervals of 15 seconds, 18 measurements (suspension flow in kg/h) were registered, which are indicated in the following Table in the column "Suspension flow IDM".

| Measurement Number | Suspension flow IDM | Suspension flow according to invention |
|---|---|---|
| 1 | 248 | 291 |
| 2 | 236 | 294 |
| 3 | 223 | 300 |
| 4 | 240 | 303 |
| 5 | 219 | 300 |
| 6 | 246 | 291 |
| 7 | 261 | 300 |
| 8 | 245 | 304 |
| 9 | 221 | 298 |
| 10 | 232 | 301 |
| 11 | 258 | 303 |
| 12 | 234 | 297 |
| 13 | 219 | 291 |
| 14 | 238 | 303 |
| 15 | 226 | 293 |
| 16 | 240 | 300 |
| 17 | 270 | 304 |

-continued

| Measurement Number | Suspension flow IDM | Suspension flow according to invention |
|---|---|---|
| 18 | 224 | 303 |
| Mean value: | 237.78 | 298.67 |
| Standard deviation | 14.96 | 4.72 |

From the Table it can be seen that according to the invention a more precise control of the suspension flow than using the inductive flowmeter can be attained.

We claim:

1. A process for controlling a flowing suspension of shredded cellulose in a liquid, aqueous tertiary amine-oxide, comprising the steps of:

introducing the suspension into a vessel having an inlet for the suspension;

transporting the suspension introduced into the vessel through the vessel;

discharging the suspension transported through the vessel through an outlet;

measuring the weight of the vessel;

controlling the introduction and discharge of the suspension by comparing the measured weight of the vessel to a predetermined set value.

2. A process according to claim 1, wherein said suspension comprises:

12 to 15% by mass cellulose;

18 to 25% by mass water; and 60 to 65% by mass tertiary amine-oxide, wherein % by mass is based on the total mass of the suspension.

3. A process according to claim 1 or 2, wherein said vessel is a pump.

4. A process according to claim 1 or 2, wherein said vessel is a buffer vessel.

5. A process according to claim 1 or 2, wherein said vessel comprises a pump and a buffer vessel.

* * * * *